US005488939A

United States Patent [19]

Nakai et al.

[11] Patent Number: 5,488,939

[45] Date of Patent: Feb. 6, 1996

[54] CRANKCASE VENTILATION SYSTEM FOR OUTBOARD MOTOR

[75] Inventors: Hiroshi Nakai; Akihiko Hoshiba; Yasuhiko Shibata, all of Hamamatsu, Japan

[73] Assignee: Sanshin Kogyo Kabushiki Kaisha, Japan

[21] Appl. No.: 302,277

[22] Filed: Sep. 8, 1994

[30] Foreign Application Priority Data

Sep. 8, 1993 [JP] Japan ..... 5-246092

[51] Int. Cl.[6] ..... B63H 21/26

[52] U.S. Cl. ..... 123/572; 123/184.35

[58] Field of Search ..... 123/572, 573, 123/574, 41.86, 184.21, 184.35, 184.53, 184.43, 184.44, 184.36, 184.32, 196 R

[56] References Cited

U.S. PATENT DOCUMENTS

| | | | |
|---|---|---|---|
| 2,971,505 | 2/1961 | Fortney | 123/572 |
| 4,493,295 | 1/1985 | Ampferer | 123/572 |
| 4,517,951 | 5/1985 | Otaka et al. | 123/572 |
| 4,528,969 | 7/1985 | Senga | 123/572 |
| 4,779,601 | 10/1988 | Dallman | 123/572 |
| 4,811,697 | 3/1989 | Kurahashi | 123/184.35 |
| 5,195,481 | 3/1993 | Oyama et al. | 123/196 R |

FOREIGN PATENT DOCUMENTS 4-1661 of 1992 Japan .

*Primary Examiner*—Marguerite Macy
*Attorney, Agent, or Firm*—Knobbe, Martens, Olson & Bear

[57] ABSTRACT

A ventilation system is provided for an engine crankcase of a marine outboard motor to distribute blow-by gas generally equally to each cylinder while minimizing the size of an intake silencer of the system. The intake silencer includes a first expansion chamber into which the blow-by gas is introduced from a blow-by gas camber attached to the cylinder head. The blow-by gas diffuses and mixes with ambient air which is drawn into the first expansion chamber through an inlet port of the induction system. The air/blow-by gas mixture is then drawn into a second expansion chamber where it distributes generally evenly before induction into a charge forming device.

19 Claims, 5 Drawing Sheets

CRANKCASE VENTILATION SYSTEM FOR OUTBOARD MOTOR

BACKGROUND OF THE INVENTION

1. Field of the Invention

The present invention relates in general to a marine propulsion system, and more particularly to a marine engine.

2. Description of Related Art

Conventional internal combustion engines typically circulate air within the lubrication system of the engine to enhance lubrication and to extend the life of the lubricant. For this purpose, many internal combustion engines allow some combustion gases, which blow by the piston rings into the crankcase ("blow-by gases"), to circulate within the lubrication system.

Internal combustion engines typically employ a ventilation system to vent the blow-by gas from the lubrication system in order to produce an air flow through the crankcase. Such ventilation systems are common in both outboard motors and inboard-outboard motors.

Prior ventilation systems commonly exhaust the blow-by gas from the lubrication system at the cylinder head and introduce the removed blow-by gas back into the induction system for eventual expulsion through a conventional exhaust system. These systems typically direct the blow-by gas into an intake silencer of an induction system of the engine via a hose, which is passed around the periphery of the engine. In the intake silencer, the blow-by gas often initially flows into a dedicated expansion chamber to diffuse before induction into the engine. The dedicated expansion chamber and an induction passage within the intake silencer commonly are positioned in parallel so that the blow-by gas is drawn into the air flow within the induction passage just before the air enters a fuel charge forming device (e.g., a set of carburetors). Japanese Patent Publication 4-1661 discloses an example of one such prior ventilation system.

Though effective in venting blow-by gas from the crankcase, prior ventilation systems commonly are too large and protrusive, and overly complicated. Consequently, the girth of the engine and protective cowling must be increased, thereby increasing drag on the watercraft.

Prior crankcase ventilation systems also do not evenly distribute the blow-by gas between all cylinders. These systems tend to introduce the blow-by gas at an edge of the airflow stream through the intake silencer and do not facilitate thorough mixing of the air and blow-by gas before induction into the charge forming device. For instance, where the charge forming device comprises aligned carburetors (such as illustrated in Japanese patent publication 4-1661), those carburetors closest to the side of the airstream where the blow-by gas is introduced receive a higher concentration of blow-by gas than do the balance of the carburetors. As a result, the blow-by gas is not evenly distributed between the cylinder, and some cylinders run on a richer air/fuel mixture than others, thus affecting the performance of the engine.

SUMMARY OF THE INVENTION

A need therefore exists for an improved blow-by gas ventilation system of simple and compact construction which generally distributes the blow-by gas evenly between the cylinders.

In accordance with an aspect of the present invention, a ventilation system for a crankcase of an internal combustion engine is provided. The ventilation system comprises an intake silencer which includes at least first and second expansion chambers in communication with each other. The first and second expansion chambers are arranged so that ambient air flows into the first expansion chamber before it flows into the second expansion chamber. An induction conduit is coupled to the engine to vent blow-by gas from the engine. The conduit extends between the engine and the first expansion chamber so as to direct blow-by gas into the first expansion chamber of the intake silencer.

In accordance with another aspect of the present invention, a ventilation system for a crankcase .of an internal combustion engine of a marine drive is connected to an intake system. The intake system comprises a plurality of induction conduits going to a plurality of intake pipes of the engine. The ventilation system includes a blow-by gas chamber attached to the engine to collect blow-by gas. An intake silencer commonly connects to the plurality of induction conduits, and includes multiple gas expansion chambers. A first expansion chamber of the multiple chambers is arranged to receive a flow of ambient air. The first expansion chamber also connects to the blow-by gas chamber in a manner that directs the collected blow-by gas into the first expansion chamber for mixture with the ambient air.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE PREFERRED EMBODIMENT

Figure 1:
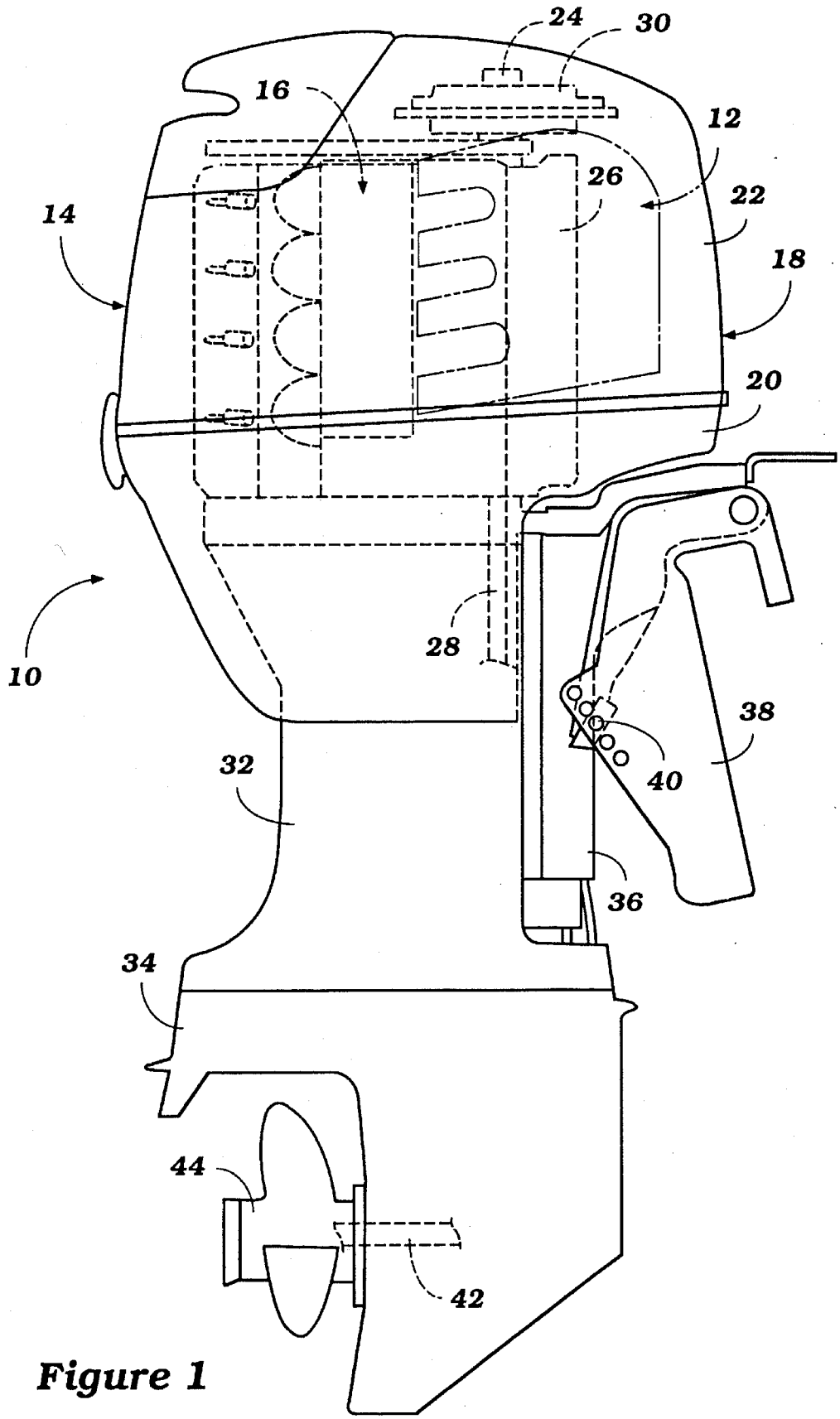
FIG. 1 is a side elevational view of a marine outboard motor which incorporates a blow-by gas ventilation system in accordance with a preferred embodiment of the present invention.

FIG. 1 illustrates a marine outboard drive 10 which incorporates a blow-by gas ventilation system 12 configured in accordance with a preferred embodiment of the present invention. In the illustrated embodiment, the outboard drive 10 is depicted as an outboard motor for mounting on the stern of a watercraft. It is contemplated, however, that those skilled in the art will readily appreciate that the present blow-by gas ventilation system 12 can be applied to an engine of an inboard-outboard motor of a watercraft as well.

In the embodiment illustrated in FIG. 1, the outboard drive 10 has a power head 14 which includes an internal combustion engine 16. A protective cowling assembly 18 of a known type surrounds the engine 16. The cowling assembly 18 desirably includes a lower tray portion 20 and a top cowling member 22. These elements 20, 22 of the protective cowling assembly 18 together define an engine compartment 21 which houses the engine 16.

Figure 2:
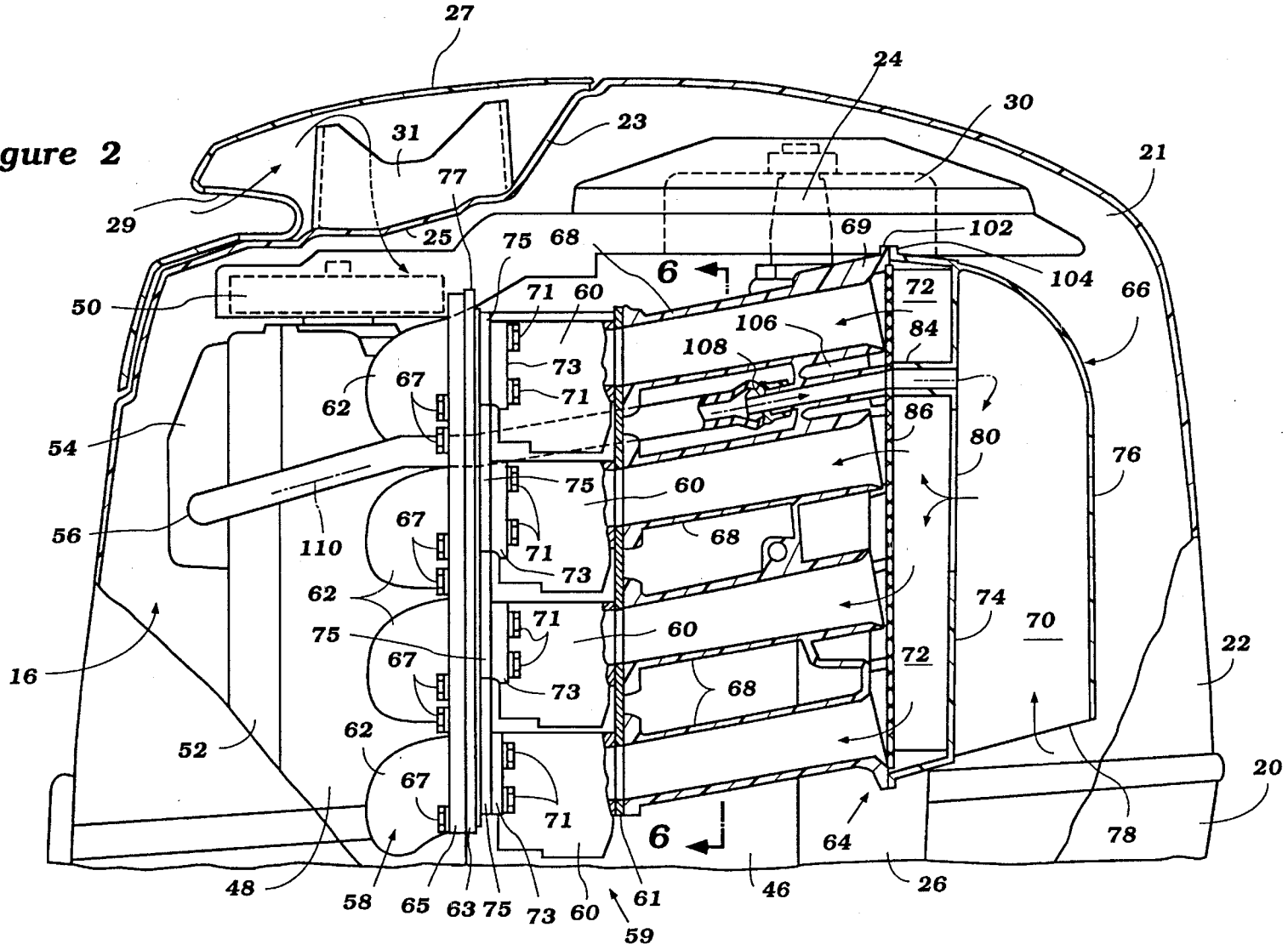
FIG. 2 is an enlarged, cut-away side elevational view of a power head of the marine outboard motor of FIG. 1.

With reference to FIG. 2, the top cowling 22 includes a relief 23 which includes at least one aperture 25. The aperture 25 opens into the engine compartment 21 of the cowling assembly 18. A handle insert 27 is affixed to the top cowling 22 within the recess 23 and over the aperture 25. The handle insert 27 includes an inlet opening 29 to allow ambient air to flow inside the handle insert 27, through the aperture 25 and into the engine compartment 21. The handle insert 27 also includes a baffle 31 disposed between the inlet opening 29 and the cowling aperture 25 to inhibit water flow into the engine compartment 21. As known in the art, the configuration of the opening 29 provides an effective drain for the water removed from the influent air flow by the baffle 31, as well as functions as a handle for raising and lowering the outboard drive 10.

As generally seen in FIG. 1, the engine 16 in the illustrated embodiment is a four stroke, in-line four cylinder compression engine. It is understood, however, that the present blow-by gas ventilation system can be employed with engines having other number of cylinders, having other cylinder orientations, and/or operating on other than a four stroke principal.

Tile engine 16 is conventionally mounted with its output shaft 24 (i.e., crankshaft) rotating about a generally vertical axis. The crankshaft 24 is suitably journaled for rotation within a crankcase 26 and drives a drive shaft 28, which depends from the power head 14 of the outboard drive 10. A standard magnetic flywheel 30 is attached to the upper end of the crankshaft 24.

As seen in FIG. 1, an intermediate housing 32 depends from the power head 14 and terminates in a lower unit 34. A steering bracket 36 is attached to the intermediate housing 32 in a known matter. The steering bracket 36 also is pivotably connected to a clamping bracket 38 by a pin 40. The clamping bracket 38, in turn, is configured to attach to a transom of the watercraft (not shown). This conventional coupling permits the outboard drive 10 to be pivoted relative to the steering bracket 36 for steering purposes, as well as to be pivoted relative to the pin 40 to permit adjustment to the trim position of the outboard drive 10.

Although not illustrated, it is understood that a conventional hydraulic tilt and trim cylinder assembly, as well as a conventional hydraulic steering cylinder assembly could be used as well with the present outboard drive. It is also understood that the above description of the construction of the outboard drive is conventional, and, thus, further details of the steering, trim, and mounting assemblies are not necessary for an understanding of the present invention.

As schematically illustrated in FIG. 1, the drive shaft 28 extends through and is journaled within the intermediate housing 32. A transmission (not shown) selectively couples the drive shaft 28 to a propulsion shaft 42. The transmission desirably is a forward, neutral, reverse-type transmission. In this manner, the drive shaft 28 rotationally drives the propulsion shaft 42 in either of two directions.

The propulsion shaft 42 drives a propulsion device 44, such as, for example, a propeller, a hydrodynamic jet, or the like. In the illustrated embodiment, the propulsion device 44 is a single propeller; however, it is understood that a counter-rotational propeller device that includes a first propeller designed to spin in one direction and to assert a forward thrust, and a second propeller designed to spin in the opposite direction and to assert a forward thrust, may be used as well.

With reference to FIG. 2, the engine 16 includes a cylinder block 46 which in the illustrated embodiment defines four aligned cylinder bores (not shown). Pistons (not shown) reciprocate within the cylinder bores, and connecting rods (not shown) link the pistons and the crankshaft 24 together so that the reciprocal linear movement of the pistons rotates the crankshaft 24 in a known manner. The crankcase 26, attached to the cylinder block 46 by known means, surrounds at least a portion of the crankshaft 24.

On the opposite end of the cylinder block 46, a cylinder head 48 is attached. The cylinder head 48 has a conventional construction. The cylinder head 48 supports and houses a plurality of intake and exhaust valve (not shown), as well as intake and exhaust camshafts (not shown) which operate the valves. An external belt 50 (best seen in FIG. 3) extends between the crankshaft 24 and a camshaft to drive the camshafts, as known in the art. A camshaft cover 52, attached to the cylinder head 48, encloses the intake and exhaust camshafts within the cylinder head 48.

The engine 16 also includes a conventional lubrication system (not individually shown) which circulates lubricant between the crankcase 26 and the cylinder head 48. As noted above, the lubricant flow within the lubrication system entrains at least a portion of those gases which pass through combustion rings of the pistons into the crankcase 26 (i.e., blow-by gas). The lubricant flow thus carries the blow-by gases between the crankcase 26 and the cylinder head 48.

Figure 3:
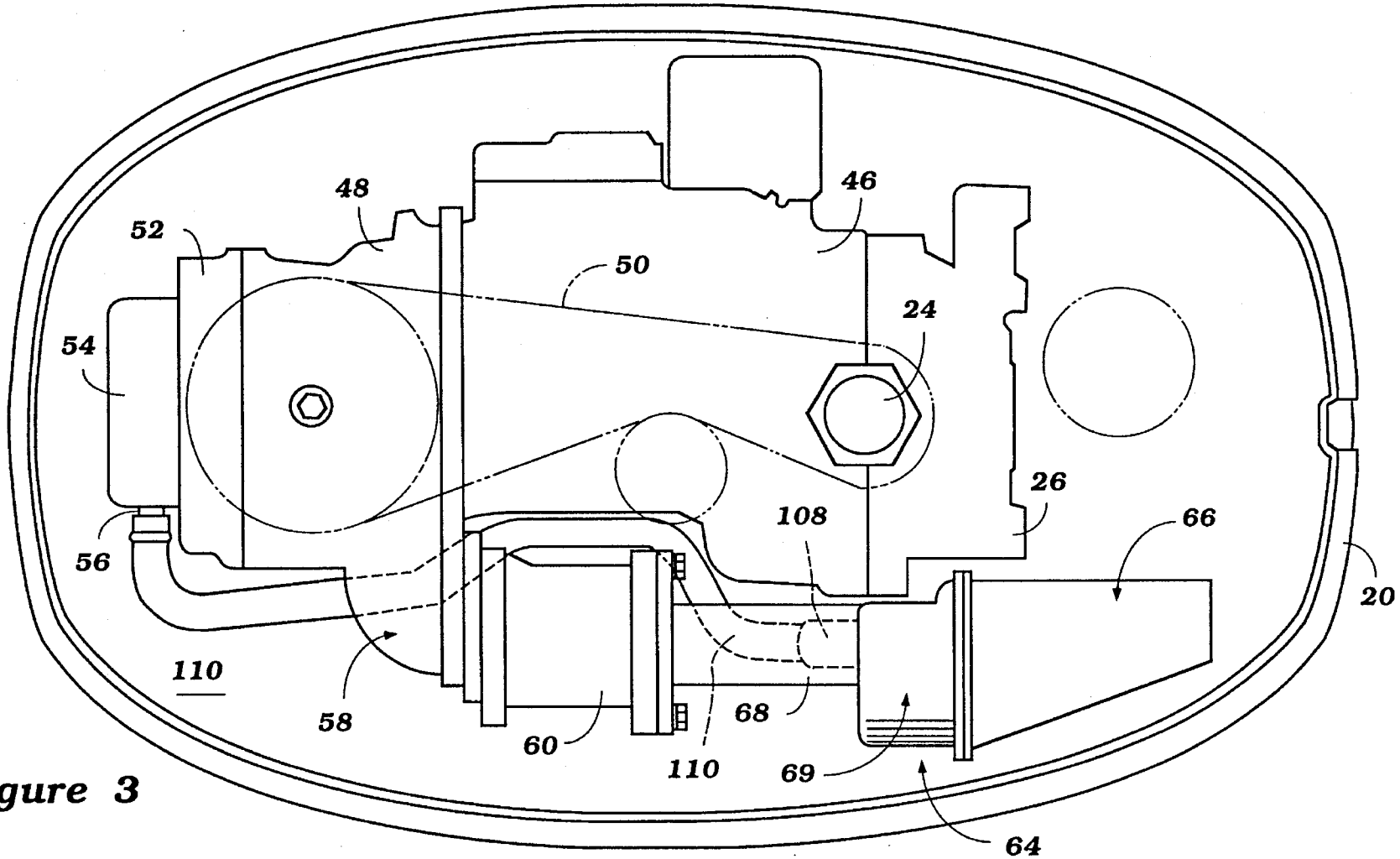
FIG. 3 is a top plan view of the power head of FIG. 2 with a top cowling of the power head removed to expose an engine.

As seen in FIGS. 2 and 3, a blow-by gas ventilation chamber 54 is attached to the camshaft cover 50 and communicates with the interior of the cylinder head 48. The chamber 54 houses a conventional baffling device (not shown) which separates a portion of the blow-by gas from the lubricant. The chamber 54 also includes an effluent port 56 for venting the blow-by gas from the cylinder head 48, as discussed below. As best seen in FIG. 3, the effluent port desirably is configured as a hose bib.

With reference to FIG. 2, an intake manifold 58 is interposed between a charge forming device 59 and the cylinder head 48. In the illustrated embodiment, the charge forming device 59 comprises a plurality of vertically aligned carburetors 60 connected to the intake manifold 58. It should be noted, however, that the present blow-by gas ventilation system 12 can be used equally well where the charge forming device 59 is a conventional fuel injection device.

The intake manifold 58 desirably is integrally formed with the cylinder head 48, and communicates with each cylinder bore via valve ducts (not shown) in the cylinder head 48, thus placing each carburetor 60 in communication with one of the cylinder bores of the cylinder block 46. In this manner, as known in the art, the carburetors 60 supply a fuel and air mixture to the engine 16.

Each carburetor 60 desirable is aligned with an intake pipe 62 of the intake manifold 58; however it is understood that an unequal number of carburetors 60 and intake pipes 62 can be used. In addition, it also is understood that, although the illustrated bank of carburetors 60 comprises four carburetors 60, the present blow-by gas ventilation system can be used with any number of carburetors 60.

In the illustrated embodiment, the carburetors 60 are mounted between a pair of support plates 61, 63. Each support plate 61, 63 includes a series of apertures equal in size to and aligned with the inlet and outlet openings of the carburetors 60, respectively. The support plate 63 on the outlet side of the carburetors 60 attaches to a flange 65 of the intake manifold 58 by bolts 67. The carburetors 60 in turn are connected to the support plate 63. Specifically, as discussed in detail in copending U.S. patent application Ser. No. 08/302,217 (attorney docket No. SANSH2.661A), filed Sep. 8, 1994, in the names of Hiroshi Nakai, Akihiko Hoshiba and Yasuhiko Shibata, and assigned to the assignee hereof, which is hereby incorporated by reference, bolt 71 secures a carburetor flange 73 to a corresponding support flange 75. An insulator member 77 elastically bonds the support flanges 75 to the support plate 63 to thermally and vibrationally decouple the carburetors 60 from the cylinder head 48, as discussed in detail in copending application Serial No. (unknown) (attorney docket No. SANSH2.589A), filed Sep. 8, 1994, in the names of Sadato Yoshida, Hiroshi Nakai, Akihiko Hoshiba and Yasuhiko Shibata, and assigned to the assignee hereof, which is hereby incorporated by reference.

The engine 16 also includes an induction system 64, as illustrated in FIG. 2. The induction system 64 includes an intake silencer 66 which draws air into the engine 16 from the interior of the cowling 18. A series of induction pipes 68 of the induction system 64 deliver air from the intake silencer 66 to the carburetors 60, as discussed below. The lengths of the induction pipes 68 desirably are tuned with the silencer 66 to minimize the noise produced by the induction system 64, as known in the art.

In the illustrated embodiment, the induction pipes 68 preferably are integrally formed with one another in a single cast assembly 69 ("induction pipe casting") to ease assemble. The outlet end of the induction pipe casting 69 desirably is bolted to the support plate 61 of the carburetor assembly.

Except for the carburetor mountings, the outboard drive 10 so far described is generally typical of prior outboard drive construction. However, in accordance with the present invention, the illustrated engine 16 incorporates the present blow-by gas ventilation system 12 to improve diffusion and mixture of vented blow-by gas with ambient air before induction into the engine 16. In addition, the blow-by gas ventilation system 12 provides for a more even distribution of blow-by gas between the engine cylinders, without employing a specific expansion chamber for the blow-by gas. Consequently, the size of the silencer 66 and the overall girth of the engine 16 is reduced.

The by-blow gas ventilation system 12 includes an improved silencer 66 configuration which includes a plurality of chambers. In the illustrated embodiment, the silencer 66 includes a first expansion chamber 70 and a second expansion chamber 72 which are separated by wall 74 within the housing 76 of the silencer 66. The first expansion chamber 70 desirably has a volume larger than the volume of the second expansion chamber 72, and more preferably has a volume at least twice as large as that of the second expansion chamber 72, for the reasons explained below.

The silencer housing 76 includes an inlet 78 positioned at the bottom of the housing 76 and facing in the downward direction. This configuration and orientation generally prevents any water, which enters the engine compartment 21 through the inlet opening 29 in the cowling assembly 18, from being drawn into the engine 16. The inlet 78 opens into the first expansion chamber 70 of the silencer 66.

The first expansion chamber 70 communicates with the second expansion chamber 72 through an aperture 80 in the wall 74. The aperture 80 desirable is distanced from the inlet 78 to prevent ambient air from flowing directly into the second expansion chamber 72, without the air first flowing through at least a portion of the first expansion chamber 70. In the illustrated embodiment, the aperture 80 is positioned about at the middle of the wall 74, as viewed in the vertical direction (i.e., in the direction of the crankshaft axis). The second expansion chamber 72 in turn communicates with the induction pipes 68, as discussed below.

The wall 74 also defines a second aperture 82 that opens into a lumen of a tube segment 84. The tube segment 84 desirably has a length generally each to the depth of the second expansion chamber 72, as measured in the direction of air flow.

Figure 4:
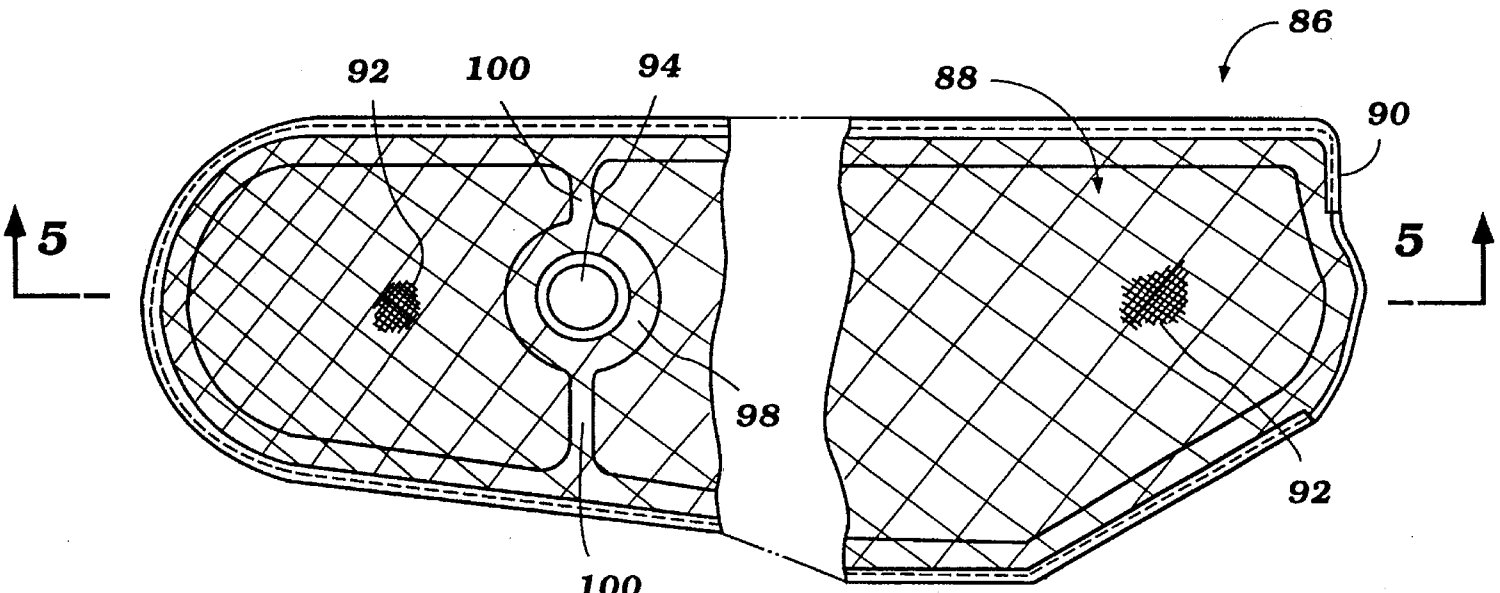
FIG. 4 is a plan view of a filter of the blow-by gas ventilation system of FIG. 2.

A filter element 86 is interposed between the induction pipe casting 69 and the silencer 76 to inhibit objects from entering the induction pipes 68. With reference to FIG. 4, the filter element 86 is configured to cover the inlets openings of the induction pipes 68, and more preferably configured to have a shape commensurate with the shape of the inlet side end of the induction pipe casting 69.

Figure 5:
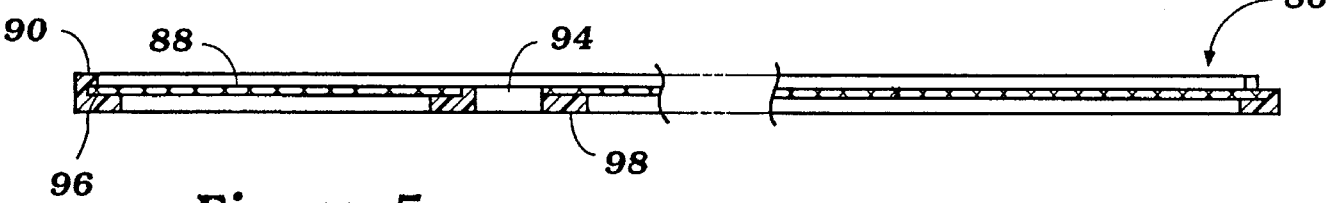
FIG. 5 is a cross-sectional view of the filter of FIG. 4 taken along line 5—5.

As best seen in FIG. 5, the filter element 86 comprises a filter membrane 88 and a periphery seal 90. In the illustrated embodiment, the membrane 88 is a fine metal or plastic wire mesh formed by a plurality of crossing wires 92, but it is understood that other types of membranes, such as, for example, foam, paper, etc., can be used as well. FIG. 5 schematically illustrates the majority of fine wire mesh of the filter member 88 by largely spaced crossing lines with several small areas of the actual mesh being shown. It should be understood, however, that the entire filter membrane 88 is formed of a fine mesh layer.

The filter membrane 88 also defines a hole 94 at a position which corresponds to the position of the pipe segment 84 when the filter element 86 is positioned over the second expansion chamber 72 of the silencer 66. In this manner, the filter element 86 does not cover the end of the pipe segment 84.

With reference to FIG. 4, the periphery seal 90 extends around the exterior of the filter membrane 88 and, as best seen in FIG. 5, supports the membrane 88 within an inner groove 96 which captures the edge of the membrane 88. As seen in FIGS. 4 and 5, the seal 90 also includes a sealing member 98 disposed around and extended into the hole 94 in the filter member 88. Integral arms 100 (see FIG. 4) of the seal 90 support the hole sealing member 98 within the interior of the periphery seal 90.

In assembly, as illustrated in FIG. 2, an exterior flange 102 of the induction pipe casting 69 and an exterior flange 104 of the silencer 66 compress the periphery seal 90 to seal the joint between the silencer 66 and the induction pipe casting 69. The induction pipe casting 69 and the silencer 66 are connected together by conventional means. The end of the pipe segment 84 also compresses the hole sealing member 98 against the inlet end of the induction pipe casting 69 to seal the lumen of the pipe segment 84 from the second expansion chamber 72 and the inlets of the induction pipes 68.

The blow-by ventilation system 12 also includes a conduit which places the effluent port 56 of the blow-by gas chamber 54 in communication with the first expansion chamber 70 of the silencer 66. For this purpose, the induction pipe casting 69 defines a passageway 106 that extends from the inlet side of the induction pipe casting 69 to a hose bib 108 positioned at an accessible position. A flexible hose 110 connects the effluent port 56 of the blow-by gas chamber 54 to the passageway 106 of the induction pipe casting 69. Hose clamps or other conventional means (not shown) secure the hose 110 to the effluent port 56 and to the hose bib 108 of the induction pipe casting 69.

In the illustrated embodiment, the hose bib 108 is positioned between the first and second induction pipes 68 (counting from the top of the figure down). The passageway 106 also extends from a position on the inlet side of the induction pipe casting 69 which corresponds to the end of the tube segment 84 when assembled. A duct thus is formed, by the tube segment 84, casting passageway 106, and the hose bib 108. This duct desirably is located between the induction pipes 68 to produce a compact assembly, but it is understood that the duct can be located at a variety of different positions around the induction system 64.

Figure 6:
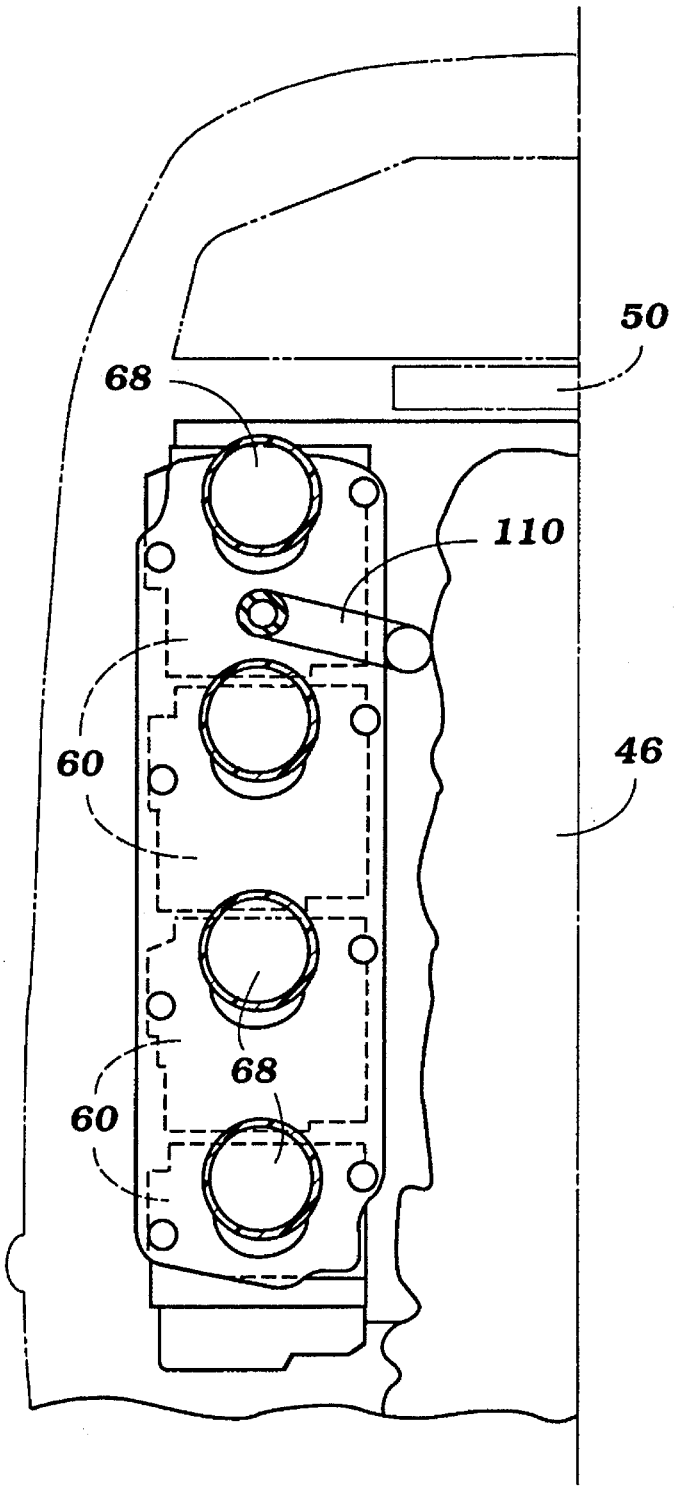
FIG. 6 is a partial cross-sectional view taken through a series of induction pipes of an induction system of the power head of FIG. 2, taken along line 6—6.

As best seen in FIGS. 3 and 6, the flexible hose 110, when installed, is bent around a corner of the cylinder head 8, bent around the bank of carburetors 60 and positioned between the cylinder block 46 and a carburetor 60. The hose 110 then is routed back around the carburetor 60 and between two induction pipes 68. This hose routing does not increase the girth of the engine 16.

In operation, the blow-by gas chamber 54 separates blow-by gas from the lubricant. Because of the resultant negative pressure within the silencer 66 caused by air flow therethrough, the blow-by gas flows through the effluent port 56 of the chamber 54, through the conduit formed by the hose 110, casting passageway 106 and pipe segment 84, and into the first expansion chamber 70.

As seen in FIG. 2, the blow-by gas is introduced into the first expansion chamber at a location distanced from the inlet 78 of the intake silencer 66 to minimize the risk of the blow-by gas escaping to the atmosphere. In addition, the blow-by gas and the air are introduced into the first expansion chamber 70 on opposite sides of the first wall aperture 80 to promote mixing of the blow-by gas and air. For this purpose, the second wall aperture 80 is located on a side of the first wall aperture 80 opposite that of the inlet 78.

The blow-by gas diffuses in the first expansion chamber 70 as it mixes with ambient air drawn into the first expansion chamber 70 through the inlet opening 78 in the silencer housing 76. The first expansion chamber 70 desirably has a sufficiently large size to foster diffusion of the blow-by gas.

The mixture of blow-by gas and ambient air ("air mixture") flows from the first expansion chamber 70 into the second expansion chamber 72 where the air mixture distributes substantially uniformly across the openings of the induction pipes 68. That is, the pressure within the second expansion chamber 72 is generally uniform across the inlets of each induction pipes 68. Consequently, the air mixture is distributed almost equally to each cylinder without employing a specific expansion chamber for the blow-by gas.

The second expansion chamber 72 can be substantially smaller in size than the first expansion chamber 70 because the diffusion of the blow-by gas in the ambient air has already occurred in the first expansion chamber 72. Thus, the primary purpose of the second expansion chamber 72 is to provide for uniform distribution of the air mixture across the inlets of the induction pipes 68. A larger volumetric size for mixing purposes is not required. As a result of the smaller second expansion chamber 72, the intake silencer 66 can have a smaller overall size, thereby further reducing the girth of the engine 16. In addition, the even distribution of the air mixture across the inlets of the induction pipes 68 provides for a more uniform distribution of the blow-by gases to the cylinders, and consequently, engine performance improves.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A ventilation system for a crankcase of an internal combustion engine comprising an intake silencer including a unitary housing having at least first and second expansion chambers in communication with each other and separated by a wall which is common to both said first and second expansion chambers, said first and second expansion chambers being arranged so that ambient air flows into said first expansion chamber before flowing into said second expansion chamber, and an induction conduit in communication with said crankcase to vent blow-by gas from said crankcase, said conduit extending between said engine and said first expansion chamber so as to direct blow-by gas into said first expansion chamber of said intake silencer.

2. The ventilation system of claim 1 additionally comprising a blow-by gas chamber provided in said engine for collecting blow-by gas.

3. The ventilation system of claim 2, wherein said blow-by gas chamber includes a baffle to separate the blow-by gas from lubricant.

4. The ventilation system of claim 1, wherein said intake silencer includes an inlet opening which opens directly into said first expansion chamber.

5. The ventilation system of claim 4, wherein said first and second expansion chambers communicate through an aperture, and said inlet opening and said conduit are arranged so that said inlet opening introduces air on one side of said aperture and said induction conduit introduces blow-by gas on an opposite side of said aperture.

6. The ventilation system of claim 1, wherein said first expansion chamber has a volumetric size larger than that of said second expansion chamber.

7. The ventilation system of claim 6, wherein said first expansion chamber has a volumetric size at least about twice as large as that of said second expansion chamber.

8. The ventilation system of claim 1, wherein said intake silencer additionally comprises an internal passageway which provides direct communication between said induction conduit and said first expansion chamber.

9. A ventilation system for a crankcase of an internal combustion engine of a marine drive, said ventilation system connected to an intake system comprising a plurality of induction conduits going to a plurality of intake pipes of said engine, said ventilation system comprising a blow-by gas chamber provided on said engine to collect blow-by gas, and an intake silencer commonly connected to said plurality of induction conduits, said intake silencer including multiple expansion chambers, a first expansion chamber being arranged to receive a flow of ambient air and being connected to said blow-by gas chamber in a manner directing blow-by gas into said first expansion chamber for mixture with said ambient air, and a second expansion chamber in communication with said first expansion chamber, said first and second expansion chambers being formed within a unitary housing of the said intake silencer and being divided by a wall within the housing which is common to both said first and second expansion chambers, said wall defining at least an aperture for fluidic communications between first and second expansion chambers.

10. The ventilation system of claim 9, wherein said second expansion chamber of said multiple expansion chambers of said intake silencer commonly communicates with each induction conduit, said second expansion chamber arranged so as to receive a mixture of ambient air and blow-by gas from said first expansion chamber in a manner which generally uniformly distributes said mixture throughout said second expansion chamber for substantially even distribution of said mixture to said induction conduits.

11. The ventilation system of claim 9, wherein said induction conduits and said engine are arranged to define a gap therebetween, and said intake system additionally comprising a blow-by gas conduit which passes through said gap and connects said blow-by gas chamber to said first expansion chamber of said intake silencer.

12. The ventilation system of claim 11, wherein said blow-by gas conduit connects to said intake silencer at a location between two of said induction conduits.

13. The ventilation system of claim 11 additionally comprising a fuel charge forming device connected between said induction conduits and said intake pipes of said engine, said induction conduits connecting said intake silencer to said fuel charge forming device, and wherein said fuel charge forming device and said engine are arranged to define a gap through which said blow-by gas conduit passes.

14. The ventilation system of claim 9, wherein said first expansion chamber is open to ambient air.

15. The ventilation system of claim 9, wherein said first expansion chamber has a volumetric size larger than the largest volumetric size of any one expansion chamber of said multiple expansion chambers.

16. The ventilation system of claim 9, wherein said second expansion chamber of said intake silencer commonly communicates with inlet openings of each of said induction conduits.

17. The ventilation system of claim 16 additionally comprising a filter element interposed between said second expansion chamber and said inlet openings of said induction conduits.

18. The ventilation system of claim 9, wherein said intake silencer additionally comprises an internal passageway within said housing which provides direct communication between said blow-by gas chamber and said first expansion chamber.

19. The ventilation system of claim 18, wherein said induction conduits are integrally formed in a casting, said casting defining a duct between two of said induction conduits with said duct arranged to communicate with said internal passageway of said intake silencer housing.

* * * * *